United States Patent [19]

Tamazawa et al.

[11] 4,026,106

[45] May 31, 1977

[54] OVERHEAT PROTECTION DEVICE FOR A CATALYTIC CONVERTER

[75] Inventors: Tsuyoshi Tamazawa; Takashi Kunugi, both of Yokohama, Japan

[73] Assignee: Nissan Motor Co., Ltd., Japan

[22] Filed: May 9, 1975

[21] Appl. No.: 576,184

[30] Foreign Application Priority Data

May 11, 1974 Japan ..... 49-52498

[52] U.S. Cl. ..... 60/277; 60/290

[51] Int. Cl.[2] ..... F01N 3/10

[58] Field of Search ..... 60/277, 290

[56] References Cited

UNITED STATES PATENTS

| | | | |
|---|---|---|---|
| 3,805,522 | 4/1974 | Sheppard | 60/290 |
| 3,812,401 | 5/1974 | Radin | 60/277 |
| 3,851,469 | 12/1974 | Eichler | 60/277 |
| 3,861,143 | 1/1975 | Morgan | 60/277 |
| 3,919,843 | 11/1975 | Arnaud | 60/290 |

*Primary Examiner*—Douglas Hart

*Attorney, Agent, or Firm*—Robert E. Burns; Emmanuel J. Lobato; Bruce L. Adams

[57] ABSTRACT

The present invention concerns an overheat protection device for a catalytic converter in which the injection of secondary air is prevented when the temperature in the catalytic converter is higher than a lower predetermined value and a warning signal is produced when the temperature is higher than a higher predetermined value.

2 Claims, 2 Drawing Figures

OVERHEAT PROTECTION DEVICE FOR A CATALYTIC CONVERTER

BACKGROUND OF THE INVENTION

The present invention relates generally to an internal combustion engine with a catalytic converter in its exhaust system and with a secondary air injection system, and more particularly to an overheat protection device for the catalytic converter.

It is well known to treat toxic gases, such as carbon monoxide, contained in the exhaust gases emitted by the motor vehicle utilizing an internal combustion engine by passage through a catalytic converter wherein the toxic gases are brought into contact with an oxidation catalyst and thereby undergo conversion. In such manner, carbon monoxide is converted to carbon dioxide. Heretofore, many attempts have been made to protect the thermal damage of the catalyst contained in the catalytic converter that would be caused when the catalyst temperature is raised abnormally, due to some engine trouble, such as a misfire. However, none of the conventional attempts are satisfactory.

SUMMARY OF THE INVENTION

The main object of the present invention is to provide an overheat protection device in an internal combustion engine including a catalytic converter in its exhaust system, an air supply pump driven by the engine and a conduit by which secondary air is conveyed to the exhaust gases upstream of the catalytic converter, in which the supply of the secondary air to the exhaust gases is prevented or inhibited when the temperature within the catalytic converter exceeds a first predetermined value and a warning signal is produced when the temperature within a catalytic converter exceeds a second predetermined value which is higher than the first predetermined value.

BRIEF DESCRIPTION OF THE DRAWINGS

The present invention will become apparent from the following description and accompanying drawings, in which.

DESCRIPTION OF THE PREFERRED EMBODIMENTS

Figure 1:
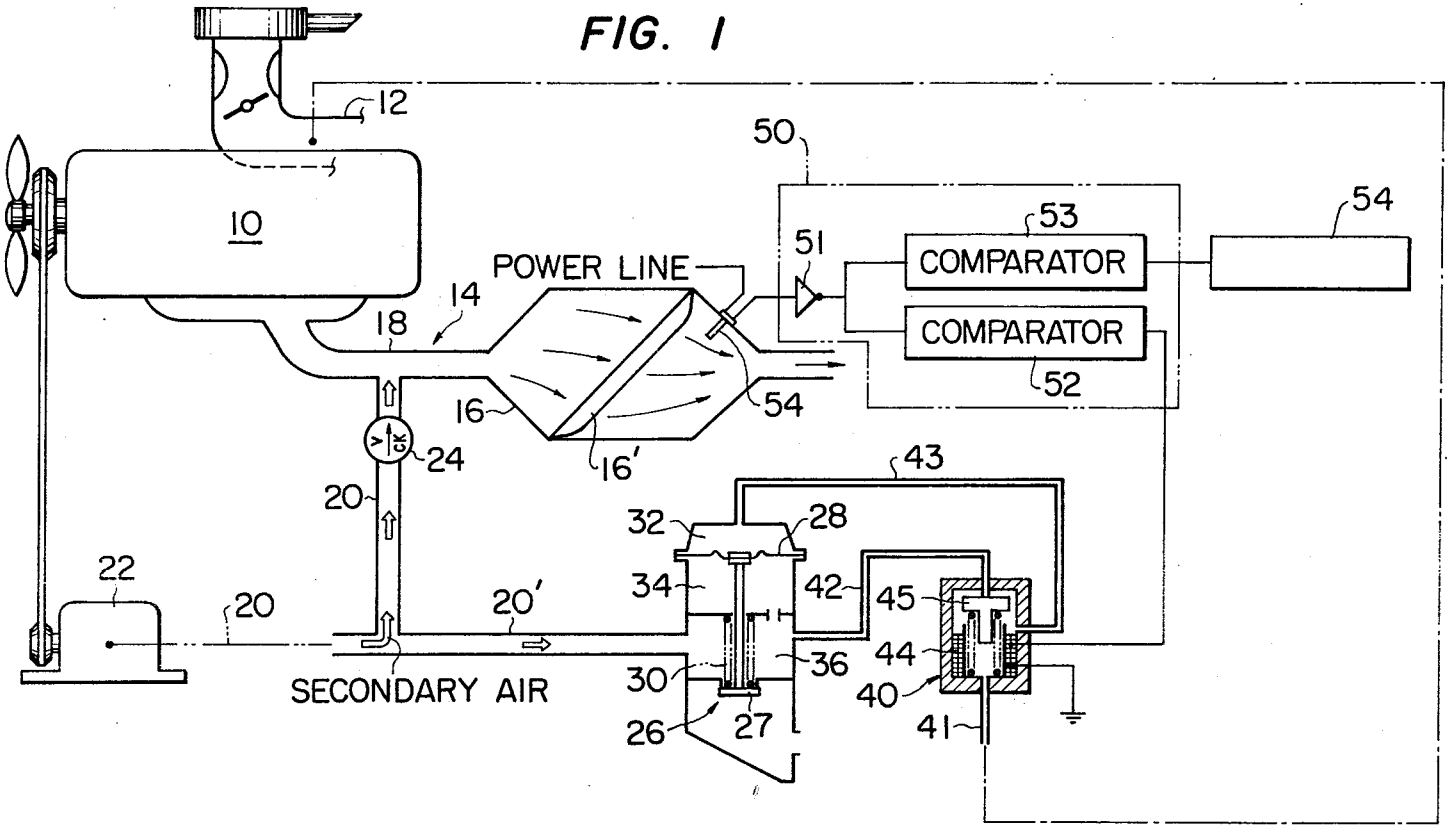
FIG. 1 is a preferred embodiment of an overheat protection device for a catalytic converter in an exhaust system of an internal combustion engine according to the present invention.

Referring now to FIG. 1, the reference numeral 10 designates an internal combustion engine for an automobile (not shown) having an intake manifold 12 and an exhaust system 14. The exhaust system 14 includes a catalytic converter 16 connected to the engine 10 by an exhaust pipe 18. To supply secondary air to the exhaust pipe 18, a conduit 20 of an air injection apparatus leads from an air supply pump 22 to the exhaust pipe 18. The air supply pump 22 is driven by the engine 10 to feed the secondary air under pressure in response to the engine rpm into the conduit 20 and, the thus fed secondary air is injected through one-way check valve 24 into the exhaust pipe 18. An exhaust conduit 20′ for the vent of excess air extends from the secondary air conduit 20. An overheat protection device comprises an air relief valve 26 under the control of which excess air is vented through the exhaust conduit 20′ to the ambient atmosphere.

The relief valve 26 comprises a pressure responsive valve element 27 connected to a flexible diaphragm 28 and biased toward its open position by a compression spring 30. The upper side of the diaphragm 28 is exposed to a working chamber 32, whereas the lower side of the diaphragm 28 is exposed to a chamber 34 which communicates with a spring accommodating chamber 36 to which the exhaust conduit 20′ opens.

The overheat protection device also comprises a solenoid valve 40, a control logic 50 associated with a thermo-sensing element 52 which extends into the catalytic converter 16 for operating the solenoid valve 40 and warning means 54.

The solenoid valve 40 is connected to the intake manifold 12 through a conduit 41 and to the chamber 36 through a conduit 42 and also connected to the working chamber 32 through a conduit 43. The solenoid valve 40 closes the conduit 42 and establishes fluid connection between the conduits 41 and 43 when a solenoid 44 is not energized and a valve element 45 is spring biased to the position shown in FIG. 1, thereby actuating the diaphragm 28 by the intake manifold vacuum applied to the working chamber 32. When the solenoid 44 is energized, the valve element 45 is retracted downwardly against the spring bias to the position shown in FIG. 2 and thus the solenoid valve 40 closes the conduit 41 and establishes fluid connection between the conduits 42 and 43. The solenoid 44 is energized under the control of the control logic 50 when the temperature in the catalytic converter 16 is higher than a first predetermined value.

The thermo-sensing element 54 extends into the catalytic converter 16 to detect temperature of exhaust gas past through a catalyst 16′ and it is electrically circuited with an input amplifier 51 of the control logic 50 to provide at the output terminal of the amplifier 51 an electric signal representative of the temperature detected by the thermo-sensing element 54. The control logic 50 includes a first comparator 52 electrically circuited with the amplifier 51 and with the solenoid 44 so that when the temperature detected by the thermo-sensing element is higher than the first predetermined value, the solenoid 44 is energized and it is kept energized as far as the temperature is higher than the first predetermined value. When the temperature detected by the thermo-sensing element 54 increases and exceeds a second predetermined value which is higher than the first predetermined value, a second comparator 53 which is electrically circuited with the amplifier 51 and with the warning means 54 will cause the warning means 54 to produce a warning signal. The warning means 54 may preferably be arranged in the instrument panel of the passenger compartment of the automobile, so that a driver may be notified by the warning signal when the temperature in the catalytic converter 16 exceeds the second predetermined value.

During the normal operation of the engine 10 the secondary air fed from the air supply pump 22 into the secondary air conduit 20 is injected through the check valve 24 into the exhaust pipe 18, so that unburned component of the exhaust gas is oxidized with the secondary air within the catalytic converter 16. The amount of the secondary air injected into the exhaust pipe 18 is controlled by the relief valve 26. During this operation of the engine 10 the temperature inside of the catalytic converter 16 is lower than the first predetermined temperature and the solenoid valve 50 is in the position shown in FIG. 1, thereby establishing connection between the conduits 44 and 43 to operate the diaphragm 28 by the intake manifold vacuum applied to the chamber 32. Accordingly, since the intake manifold vacuum operating on the upper side of the diaphragm 28 and the positive pressure of the secondary air operating on the lower side of the diaphragm 28 cooperate to urge the valve 27 against the biasing force of the spring 30 toward its closing position, amount of excessive air vented to the atmosphere is appropriately controlled in response to the engine intake manifold vacuum, the pressure of the secondary air in the conduit 20' and the biasing force of the spring 30, as long as the catalytic temperature is lower than the first predetermined value, with the result that appropriate amount of the secondary air is injected into the exhaust pipe 18 in response to the engine intake manifold vacuum. The operation of the air relief valve 26 may be understood when considering, for example, the low-speed and heavy-load operation of the engine 10 in which the amount of secondary air injected to the exhaust pipe 18 is to be reduced. During this operation of the engine, in which the intake manifold vacuum reduces and the pressure of the secondary air in the chamber 36 reduces, the force operating on the diaphragm 28 urging the valve 27 to the closing position reduces and the valve 27 is opened by the spring 30. Thus the valve 27 permits secondary air to vent to the atmosphere, thereby reducing the pressure in the conduit 20, with the result that injection amount of secondary air to the exhaust pipe 18 through the check valve 24 decreases.

Figure 2:
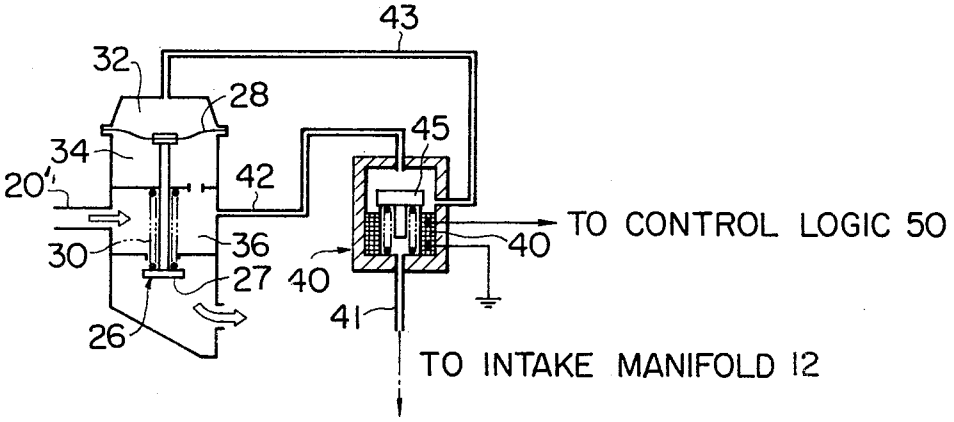
FIG. 2 is a partial fragmentary view of the device shown in FIG. 1.

When during the high-speed and heavy-load operation of the engine 10, the temperature inside the catalytic converter 16 exceeds the first predetermined value, such as 850° C, the control logic 50 permits electric current to flow through the solenoid 44 to energize the same, thereby causing the solenoid valve 40 to establish the connection between the conduits 42 and 43 (see FIG. 2). Accordingly, since the same pressure to the pressure within the chamber 34 operates immediately on the upper side of the diaphragm 28 and the force tending to urge the valve 27 against the biasing force of the spring 30 becomes zero, the valve 27 is opened fully wider by the spring 30 (see FIG. 2), thus permitting substantially all the secondary air to vent to the atmosphere. In this condition the secondary air is prevented from being injected through the check valve 24 into the exhaust pipe 18 because the check valve 24 is urged firmly to its closing position by the exhaust gas pressure which become high during the high-speed and heavy-load operation of the engine 10. Further increase of the temperature inside the catalytic converter 16 is prevented because the supply of the secondary air necessary for thermal reaction within the catalytic converter 16 is stopped and when the temperature inside the converter 16 decreases and becomes lower than the first predetermined value, i.e., 850° C, the control logic 50 prevents current from flowing through the solenoid 44 to cause the solenoid valve 40 to establish again connection between the conduits 41 and 43 (the position of FIG. 1).

It is well known to those skilled in the art that the temperature inside the catalytic converter 16 increase abruptly to thereby damage the catalyst when there is misfire of the engine 10 and relatively large amount of unburned component is contained in the exhaust gas, because such large amount of unburned component is burned at one time within the catalytic converter 16. To prevent the occurrence of the damage of the catalyst 16', when the temperature inside the catalytic converter 16 exceeds the second predetermined value (such as 1, 100° C) which is higher than the first predetermined value, the control logic 50 causes the warning means 54 to produce a warning signal. Then the driver immediately stops to inspect the engine room.

In the embodiment described in the preceding, the thermo-sensing element 54 is positioned downstream of the catalyst 16'. However, the thermo-sensing element 54 may be positioned upstream of the catalyst 16' for more rapid detection of abnormal temperature rise due to the misfire of the engine or the overflow of a carburetor.

What is claimed is:

1. In an internal combustion engine:

an intake system;

an exhaust system having a catalytic converter;

an air supply pump;

first conduit means connecting said air supply pump to said exhaust system to supply an air into said catalytic converter;

a housing divided by a movable wall defining therein first and second chambers and which moves under the control of air pressure differential between said chambers;

a partition disposed within said first chamber to divide the same into a first compartment adjacent said movable wall and into a second compartment, said partition having a passage therethrough through which said first compartment communicates only with said second compartment;

means connecting said second compartment to receive air under pressure from said air supply pump;

means defining a port through which said second compartment communicates with the atmosphere;

a valve controlled by said movable wall to open and close said port;

means disposed in said second compartment biasing said valve toward its open position;

second conduit means connecting said second chamber to receive air under pressure from said pump and a manifold pressure from said intake system;

solenoid valve means disposed in said second conduit means for selectively applying said manifold pressure and said pump pressure to said second chamber in response to deenergization and energization thereof, respectively;

warning means for producing a warning signal when energized;

thermo-sensing means for detecting the temperature within said catalytic converter;

means operatively connected with said thermo-sensing means for energizing said solenoid valve when the temperature within said catalytic converter is higher than a predetermined value and for energizing said warning means when the temperature is higher than a second predetermined value which is higher than said first mentioned predetermined value; and said movable wall urging said valve against the bias of said biasing means toward its closed position when said manifold pressure is applied to said second chamber.

2. An internal combustion engine as claimed in claim 1, in which said movable wall comprises a diaphragm.

* * * * *